US010582304B2

(12) United States Patent
Dehe et al.

(10) Patent No.: US 10,582,304 B2
(45) Date of Patent: Mar. 3, 2020

(54) DIAPHRAGM ELEMENT ARRANGEMENT AND RELATED METHOD

(71) Applicant: Infineon Technologies AG, Neubiberg (DE)

(72) Inventors: Alfons Dehe, Villingen Schwenningen (DE); Manuel Dorfmeister, Vienna (AT); Ulrich Schmid, Vienna (AT); Michael Schneider, Vienna (AT)

(73) Assignee: INFINEON TECHNOLOGIES AG, Neubiberg (DE)

( * ) Notice: Subject to any disclaimer, the term of this patent is extended or adjusted under 35 U.S.C. 154(b) by 0 days.

(21) Appl. No.: 16/186,971

(22) Filed: Nov. 12, 2018

(65) Prior Publication Data

US 2019/0149926 A1 May 16, 2019

(30) Foreign Application Priority Data

Nov. 13, 2017 (DE) ..... 10 2017 126 644

(51) Int. Cl.

| | |
|---|---|
| ***H04R 17/10*** | (2006.01) |
| ***H04R 23/00*** | (2006.01) |
| ***H04R 3/04*** | (2006.01) |
| ***H04R 7/06*** | (2006.01) |
| ***H04R 17/00*** | (2006.01) |

(52) U.S. Cl.

CPC ..... *H04R 17/10* (2013.01); *H04R 3/04* (2013.01); *H04R 7/06* (2013.01); *H04R 23/006* (2013.01); *H04R 17/00* (2013.01); *H04R 2201/003* (2013.01)

(58) Field of Classification Search

CPC . H04R 17/10; H04R 3/04; H04R 7/06; H04R 23/006; H04R 17/00; H04R 2201/003

USPC ..... 381/190

See application file for complete search history.

(56) References Cited

U.S. PATENT DOCUMENTS

| | | | | |
|---|---|---|---|---|
| 6,215,884 | B1 * | 4/2001 | Parrella | H04R 17/00 381/190 |
| 2005/0281419 | A1 * | 12/2005 | Miyazaki | B06B 1/0292 381/191 |
| 2011/0033079 | A1 * | 2/2011 | Liou | H04R 19/00 381/431 |
| 2013/0089224 | A1 * | 4/2013 | Dehe | H04R 19/013 381/191 |

* cited by examiner

*Primary Examiner* — Sean H Nguyen

(74) *Attorney, Agent, or Firm* — Slater Matsil, LLP

(57) ABSTRACT

Diaphragm element arrangements including at least one bistable diaphragm element, which has a first stable state and a second stable state, and corresponding methods are provided. The bistable diaphragm element can be activated above a changeover threshold in order to change over between the first and the second stable state or below the changeover threshold.

10 Claims, 6 Drawing Sheets

DIAPHRAGM ELEMENT ARRANGEMENT AND RELATED METHOD

This application claims the benefit of German Application No. 102017126644.5, filed on Nov. 13, 2017, which application is hereby incorporated herein by reference.

TECHNICAL FIELD

The present application relates to diaphragm element arrangements and corresponding methods, for example for generating sound.

BACKGROUND

To generate sound, use is usually made of loudspeakers which have one or more diaphragms which are set vibrating. The loudspeakers can also be fabricated as a microelectromechanical system (MEMS), in which a diaphragm is, for example, produced in a silicon wafer by etching and integrated on the silicon wafer, possibly together with the activation electronics.

Diaphragms of this type in microelectromechanical systems can be fabricated by appropriate configuration as bistable diaphragms, i.e. as diaphragms which have two stable states. In the two bistable states, the diaphragm is oppositely curved. Conventionally, the bistable diaphragm is then activated to change over between the two stable states, which generates an appropriate sound wave. By the combination of a plurality of such bistable diaphragms in an arrangement, desired sound waves, for example based on a signal which contains sound information, can then be generated.

It is desirable to increase the dynamics, sound level and/or modulation depth of such arrangements in order, for example, also to reduce total harmonic distortion (THD).

SUMMARY

According to one exemplary embodiment, a diaphragm element arrangement is provided, comprising: at least one bistable diaphragm element having a first stable state and a second stable state, and a control system for activating the at least one diaphragm element, wherein the control system is configured to activate a diaphragm element of the at least one bistable diaphragm element with a control signal above a changeover threshold in order to change over between the first stable state and the second stable state, and to activate the diaphragm element or a further diaphragm element of the at least one bistable diaphragm element with an activation signal below the changeover threshold.

According to a further exemplary embodiment, a diaphragm element arrangement is provided, comprising: a bistable diaphragm element having a first stable state and a second stable state, and a control system for activating the at least one diaphragm element, wherein the control system is configured to activate the diaphragm element to excite a self-resonant vibration, and to activate the diaphragm element with a control signal below a changeover threshold which, without the resonant vibration, would be necessary to change over between the stable states, in order to change over between the stable states.

According to an additional exemplary embodiment, methods are provided, comprising: activating a bistable diaphragm element having a first stable state and a second stable state above a changeover threshold in order to change over between the first and second stable state, and activating the bistable diaphragm element or a further bistable diaphragm element below the changeover threshold.

According to a still further exemplary embodiment, a method is provided, comprising: setting a diaphragm of a bistable diaphragm element vibrating at a self-resonant frequency of the diaphragm, and changing over the bistable diaphragm element between two stable states by activation below a changeover threshold which, without the excitation to vibrate at the self-resonance, is necessary for the changeover.

The above summary should merely be understood as a brief overview over some possible exemplary embodiments and is not to be interpreted as restrictive.

DETAILED DESCRIPTION OF ILLUSTRATIVE EMBODIMENTS

In the following text, various exemplary embodiments will be explained in detail. It should be noted that these exemplary embodiments serve merely for illustration and are not to be interpreted as restrictive. For example, components illustrated in the figures can be adapted or modified. In addition to the components illustrated, further components can be used, in particular in conventional devices for generating sound such as, for example, corresponding microelectromechanical systems.

Features or components of various exemplary embodiments can be combined with one another in order to form further exemplary embodiments. Variants and adaptations which are described for one of the exemplary embodiments can also be applied to other exemplary embodiments.

Figure 1A:
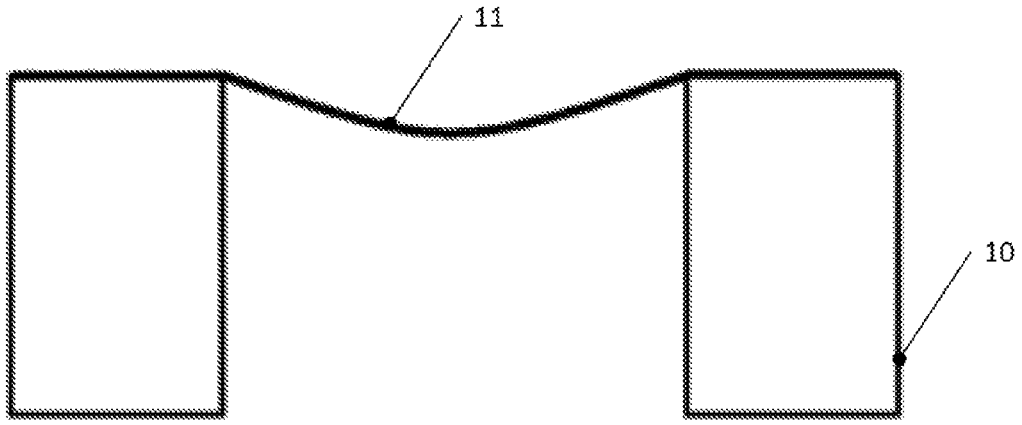
FIGS. 1A and 1B show two stable states of a bistable diaphragm element.
Figure 1B:
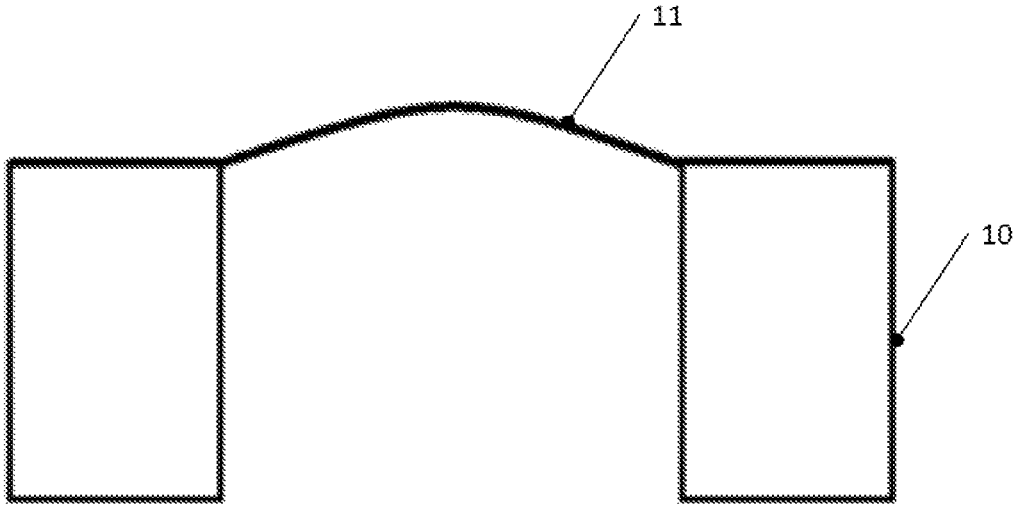

FIGS. 1A and 1B explain the concept of a bistable diaphragm, as is used in the exemplary embodiments. In FIGS. 1A and 1B, a device produced by microtechnology is illustrated schematically, in which a diaphragm 11 is specifically preloaded in order to utilize the so-called "buckling" effect. FIGS. 1A and 1B each show the diaphragm 11, which is coupled mechanically to a carrier 10, for example a semiconductor substrate such as a silicon substrate. FIG. 1A shows the diaphragm 11 in a first stable position, and FIG. 1B shows the diaphragm 11 in a second stable position. As a result of appropriate preloading, the positions shown in FIGS. 1A and 1B are stable, i.e. no supply of energy is needed in order that the diaphragm remains in the respective position; however, a supply of energy is necessary in order that the diaphragm 11 leaves the illustrated positions, in particular changes over between the positions of FIGS. 1A and 1B. The use of such a bistable diaphragm is therefore energy-efficient, since no energy is needed to maintain the stable state.

The mechanical preloading can be achieved, for example, by additional layers having a defined tension being applied to a basic diaphragm, or by tension being introduced into the diaphragm directly, e.g. by implantation of a material, or by appropriate stressing of the diaphragm being carried out in the surroundings (e.g. on carrier 10). The diaphragm can likewise comprise a semiconductor material such as silicon or other layer materials, for example silicon nitride, silicon carbon compounds or the like, and can have one or more layers. Thus, in a multilayer system, for example a mechanical stress can also be produced by materials of different lattice constants.

Figure 2:
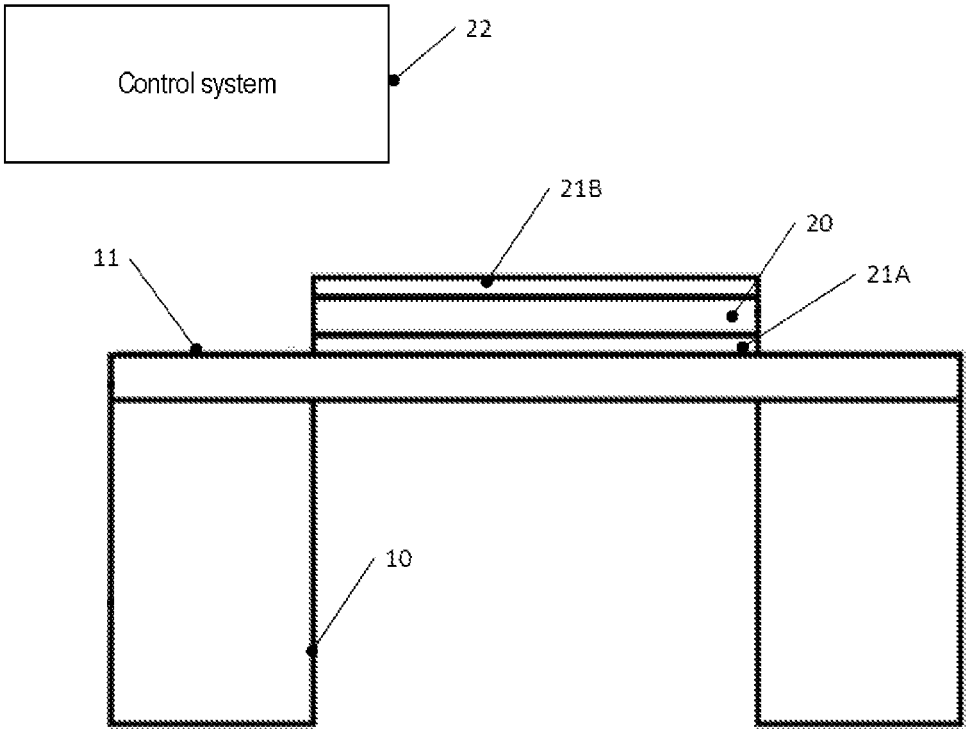
FIG. 2 shows a schematic illustration of a device according to one exemplary embodiment.

Changing over between the bistable states can be carried out by a piezoelectric actuator. FIG. 2 shows an exemplary embodiment having such a piezoelectric actuator and a control system 22. The piezoelectric actuator in the exemplary embodiment of FIG. 2 is formed on the diaphragm 11, which is carried by the substrate 10 (cf. description of FIGS. 1A and 1B). The actuator comprises a piezoelectric material 20, e.g. lead-zirconium titanate (PZT) or aluminum nitride (AlN) but is not restricted thereto. The piezoelectric material 20 is arranged between two electrodes 21A, 21B. The electrodes can comprise a metal and/or highly doped semiconductor material. When an electric voltage is applied to the electrodes 21A, 21B by the control system 22, the piezoelectric material stretches or compresses in accordance with its polarization direction (depending on the applied voltage and piezoelectric material), which applies a corresponding stress to the diaphragm 11 and, given a sufficient magnitude of the stress, i.e. the deformation of the piezoelectric material 20, effects a stress on the diaphragm 11 which exceeds a changeover threshold), a change takes place between the two stable states of the diaphragm 11, i.e. from the state of FIG. 1A to the state of FIG. 1B or vice versa.

Activation of this type, which effects the changeover of the diaphragm 11 between the two stable states, will also be designated within the context of the present invention as activation above a changeover threshold or digital activation (since it changes over between two states, similar to digital values 0 and 1).

It should be noted that the actuator with the piezoelectric element 20 does not necessarily have to be arranged on the diaphragm, as illustrated in FIG. 2, but can likewise be arranged underneath the diaphragm or both above and below the diaphragm. In addition, more than one actuator can also be provided.

In exemplary embodiments, in addition to the aforementioned digital activation, activation below the changeover threshold, also designated as analog activation below, is used. In some exemplary embodiments, a single diaphragm element as illustrated in FIG. 2 can optionally be activated digitally or in an analog manner. In other exemplary embodiments, an arrangement of multiple diaphragm elements is provided, wherein some of the diaphragm elements and other of the diaphragm elements can be activated in an analog manner. In further exemplary embodiments, by a supply of energy which leads to a vibration of the diaphragm 11 at its self-resonant frequency, a changeover between the stable states can be effected by a voltage pulse on the actuator which lies below the changeover threshold. Otherwise, a changeover can also be achieved by applying a voltage above the changeover threshold. These and other variants will be explained in more detail below.

Figure 3:
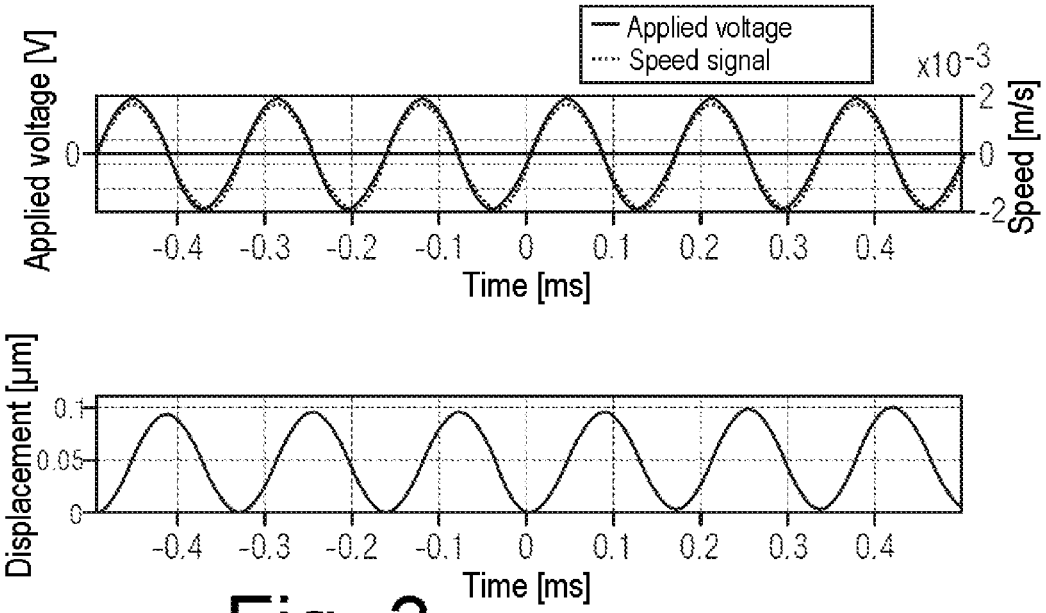
FIG. 3 shows exemplary signals to explain analog activation of a bistable diaphragm.
Figure 4:
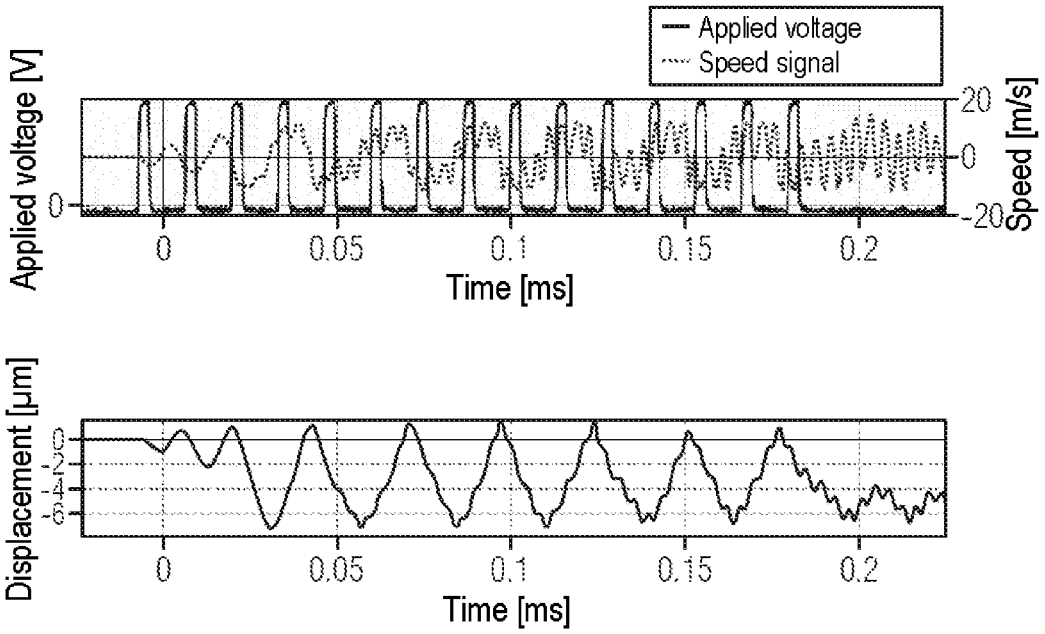
FIG. 4 shows exemplary signals to explain digital activation of a bistable diaphragm.

FIGS. 3 and 4 show diagrams which illustrate analog activation (FIG. 3) and digital activation (FIG. 4). In FIG. 3, a voltage applied to electrodes such as the electrodes 21A, 21B of FIG. 2 and the resultant speed of a diaphragm such as the diaphragm 11 are illustrated in a first diagram. In a lower graph in FIG. 3, the resultant displacement of the diaphragm is illustrated. In the example illustrated, a sinusoidal voltage profile is applied. As can be seen, given such an excitation below the changeover threshold, the speed of the diaphragm and the displacement of the diaphragm follow the sinusoidal excitation.

Figure 5:
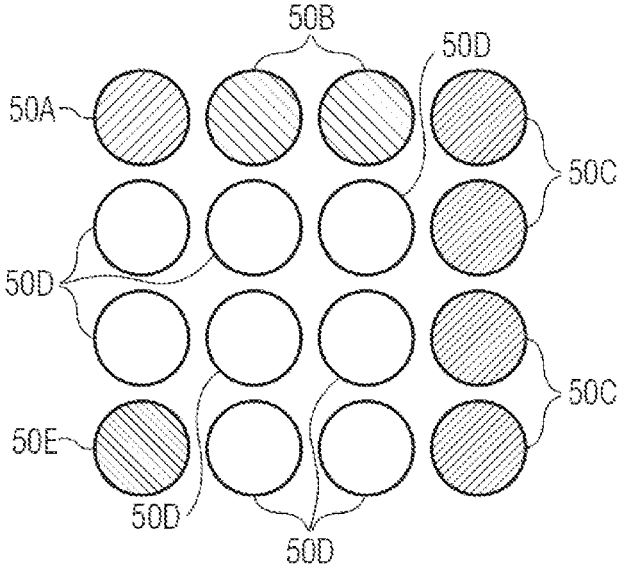
FIG. 5 shows a diaphragm arrangement according to an exemplary embodiment.

FIG. 4 shows an example in which a voltage which lies above the changeover threshold is applied periodically. In addition, the resultant speed of the diaphragm is also illustrated in an upper graph, and the resultant displacement in a lower graph. As can be seen, a changeover in this way is made between the two stable states. In the example of FIG. 5, the result of the periodic application of the changeover signal is an overswing superimposed on the speed and the displacement, although this has a smaller amplitude than the displacement which results when changing over between the states.

In exemplary embodiments, as explained, both digital activation and analog activation are used. In some exemplary embodiments, a single diaphragm element (as illustrated in FIG. 2, for example), can optionally be activated digitally or in an analog manner. In other exemplary embodiments, an arrangement of diaphragm elements, for example in the form of a two-dimensional array, is provided, wherein some of the diaphragm elements are activated digitally and other of the diaphragm elements are activated in an analog manner. Here, a diaphragm element or bistable diaphragm element is to be understood generally to be a component in which a diaphragm is activated as described, for example by a piezoelectric actuator, wherein the diaphragm in the case of a bistable diaphragm element has two stable states.

In some exemplary embodiments, digital generation of sound by digital activation of one or more bistable diaphragm elements can have an analog activation signal superimposed, in order as a result to achieve more dynamics and sound level or to increase the modulation depth. In this way, in particular, the total harmonic distortion (THD) which, in an arrangement of multiple diaphragms, arises for example as a result of a finite value of a digitization step width, can be reduced. In other words, in such an arrangement with pure digital activation, only specific "sound pressures" can be generated, since each individual bistable diaphragm element can either be changed over or not during a switching operation. By additional analog activation, "intermediate values" can be generated here.

FIG. 5 shows an exemplary embodiment having 16 bistable diaphragm elements 50, which are arranged in a 4·4 array in the example illustrated. The number of diaphragm elements and the arrangement in a 4·4 array serves merely as an example. It is also possible for more or fewer bistable diaphragm elements to be provided, and these can also be provided in arrangements other than that illustrated in FIG. 5.

In the exemplary embodiment of FIG. 5, one diaphragm element 50A represents a lowest value bit, diaphragm elements 50B represent a second bit, diaphragm elements 50C represent a third bid and diaphragm elements 50D represent a fourth bit, wherein the lowest-value, first bit is formed by one diaphragm element, the second bit by two diaphragm elements, the third bit by four diaphragm elements and the fourth bit by eight diaphragm elements. The diaphragm elements are therefore combined into groups and each group is assigned to one bit. The diaphragm element 50E is unused and can also be left out. It can also be used as a spare or for test purposes or can also be provided simply for the purpose of simplified production, for example if several of the arrangements of FIG. 5 are produced on a single chip. It should be noted that the grouping of the diaphragms to form bits of FIG. 5 and the number of four bits is used merely as an example, and other arrangements, in which for example diaphragms belonging to a bit are not located beside one another, and/or another number of bits, can be provided.

In the exemplary embodiment of FIG. 5, the two lowest value bits, i.e. the diaphragm elements 50A and 50B, are activated in an analog manner, as was illustrated with reference to FIG. 3, and the two higher value bits, i.e. the diaphragm elements 50C and 50D, are activated digitally, as was explained with reference to FIG. 4. By such a mixed use of analog and digital activation, dynamics and modulation depth of the arrangement can be increased.

Figure 6:
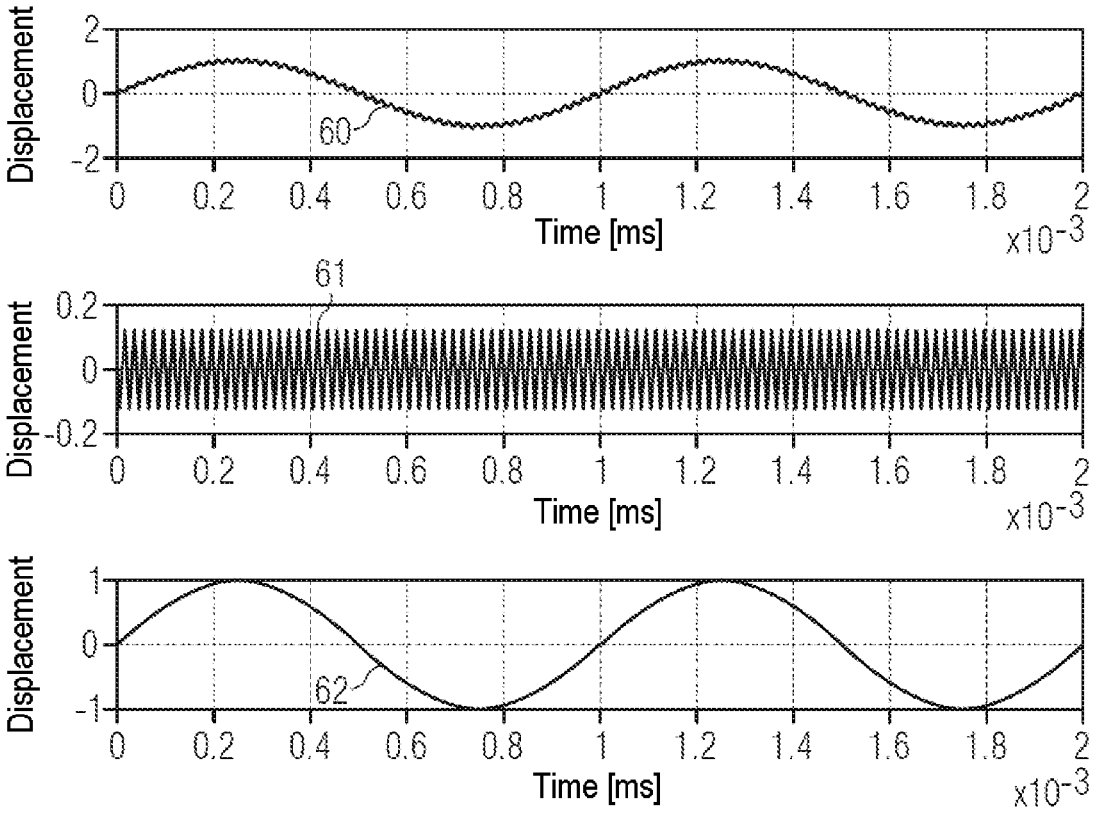
FIG. 6 shows signals to illustrate smoothing according to an exemplary embodiment.

As explained with reference to FIG. 4, repeated digital activation of diaphragm elements can lead to superimposed vibrations. In some exemplary embodiments, analog activation of other diaphragm elements can then be used to compensate for said superimposed vibrations. This will now be explained with reference to FIG. 6. In FIG. 6, curves 60, 61 and 62 each show normalized displacements of a diaphragm of the diaphragm element or a combined displacement of multiple diaphragms, i.e. the displacement is illustrated in arbitrary units. One curve 60 shows a sinusoidal vibration, which has been produced with digitally activated diaphragms which are arranged in a multiple bits (corresponding to the diaphragm elements 50C, 50D of FIG. 5). The principle of generating a signal profile by digitally activated diaphragms is also designated as digital sound reconstruction (DSR). As can be gathered from the curve 60, the higher-frequency overswings superimposed on the sine wave result.

In exemplary embodiments, these overswings can be compensated by an analog signal which runs in anti-phase relative to the overswings of curve 60 being applied to analog-activated diaphragm elements (for example diaphragm elements 50A, 50B of FIG. 5). Curve 61 shows such a signal opposite the overswings of curve 60, such as can be generated by the diaphragm elements 50A and/or 50B of FIG. 5 when an appropriate control signal is applied.

The curve 62 of FIG. 6 shows a total effective displacement or an overall generated sound signal given a combination of the digital activation with the result of the curve 60 and analog activation corresponding to curve 61. As can be seen, the overswings are smoothed in this way, and a smoothed signal is produced.

A further possible use of excitation below the changeover threshold is a changeover between the two stable states by resonance. This is illustrated in FIG. 7.

Figure 7:
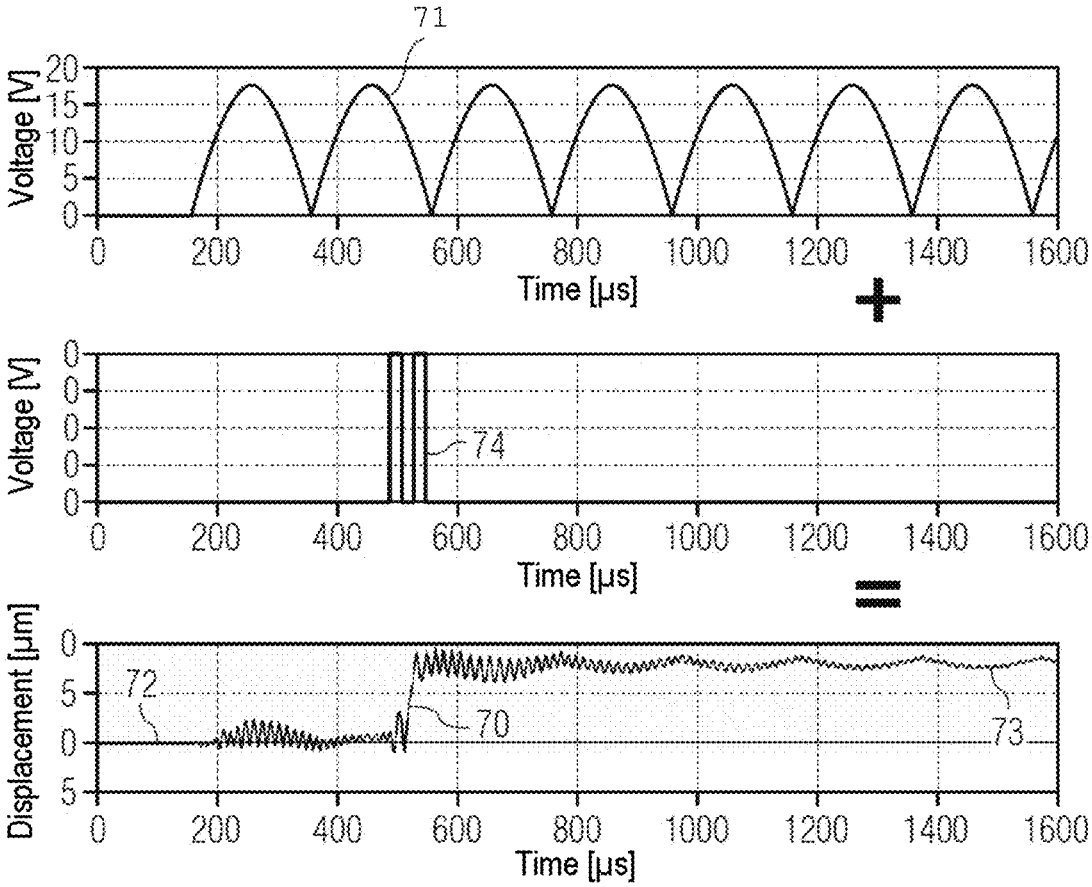
FIG. 7 shows signals to explain a changeover between stable states according to an exemplary embodiment.

A curve 70 in FIG. 7 shows a displacement of a diaphragm, wherein the diaphragm vibrates about a first stable state at the start at 72 and, at the end at 73, vibrates about a second stable state, as illustrated by 73. A curve 71 in FIG. 7 shows the voltage applied to an actuator, for example the piezoelectric actuator of FIG. 2, of the diaphragm element in the form of a periodic sequence of pulses. With this periodic voltage, the diaphragm of the diaphragm element is first excited with a very small amplitude into the self-resonant frequency of the diaphragm and therefore set vibrating permanently. This can be carried out in anti-phase, for example for various diaphragm elements in an arrangement such as the arrangement of FIG. 5, so that overall no sound is produced (i.e. the diaphragms of different diaphragm elements vibrate in anti-phase at the resonant frequency.

By amplitude modulation, i.e. additional pulses, which are superimposed on the pulses of curve 71, with which the resonance is increased, the changeover operation can then be triggered, wherein a voltage is needed which actually lies below the changeover threshold and, because of the resonant excitation, nevertheless suffices to change over between the stable states. One example of this is illustrated by a curve 74 of FIG. 7. Here, two voltage pulses are shown which are applied in addition to the pulses of curve 71, and then, as shown in the curve 70, lead to the changeover between the stable states. The number of pulses which are required for the changeover can vary, depending on implementation.

Figure 8:
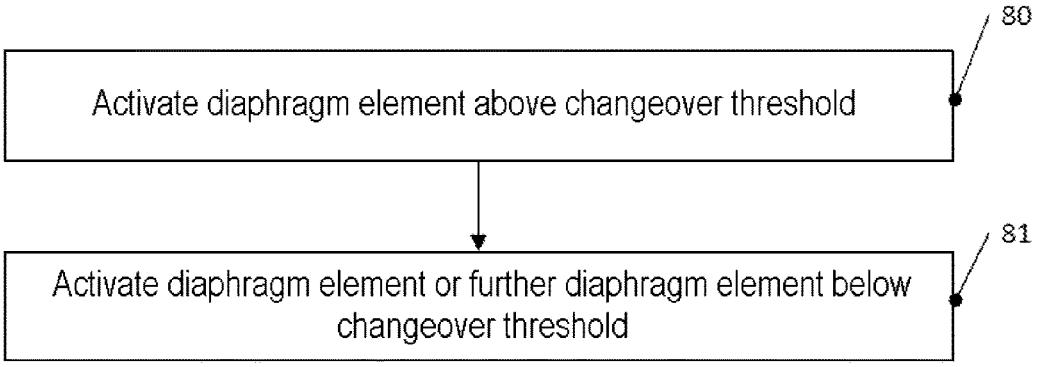
FIG. 8 shows a flowchart to illustrate a method according to one exemplary embodiment.

FIG. 8 shows a flowchart of a method according to an exemplary embodiment. The order of the procedures described with reference to FIG. 8 is not to be interpreted as restrictive, since the procedures can also be carried out in another order. The method of FIG. 8 will be explained for the purpose of illustration with reference to the exemplary embodiments described above but is not restricted thereto.

In FIG. 8, a diaphragm element is activated with a voltage above the changeover threshold. This leads to a changeover between stable states as described above.

At 81, the diaphragm element or else a further diaphragm element of a diaphragm element arrangement like the arrangement shown in FIG. 5 is activated, which corresponds to the analogue activation described. In this way, for example, smoothing as illustrated with reference to FIG. 6 can be carried out and/or a dynamic range can be increased, as likewise described above.

Details of the activation above the changeover threshold and below the changeover threshold can be carried out as explained above with reference to FIGS. 1-7.

Figure 9:
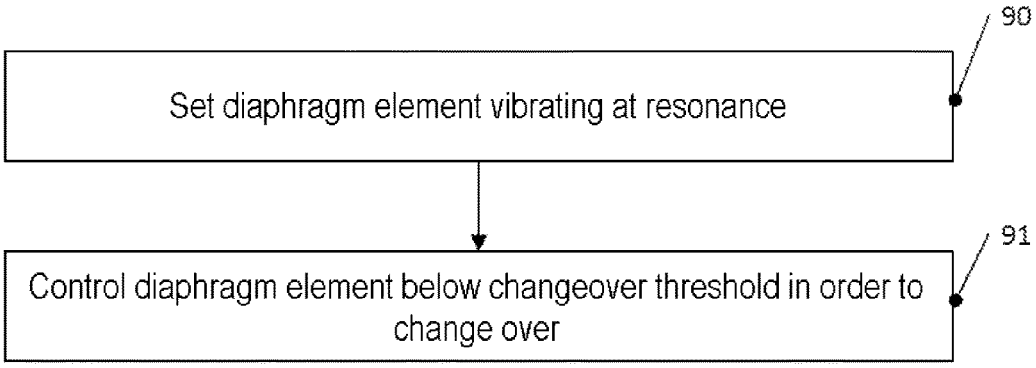
FIG. 9 shows a flowchart to illustrate a method according to a further exemplary embodiment.

FIG. 9 shows a flowchart of a method according to a further exemplary embodiment. In the exemplary embodiment of FIG. 9, a diaphragm of a diaphragm element is caused to make resonant vibrations, as was explained with reference to FIG. 7. By amplitude modulation below the changeover threshold, a changeover of the diaphragm element between two stable states can nevertheless be carried out, as was likewise explained with reference to FIG. 7. It should be noted that the exemplary embodiments of FIGS. 8 and 9 can also be used for various diaphragm elements together within a diaphragm element arrangement as illustrated in FIG. 5.

At least some exemplary embodiments are defined in the following examples:

Example 1

Diaphragm element arrangement, comprising: at least one bistable diaphragm element having a first stable state and a second stable state, and a control system for activating the at least one diaphragm element, wherein the control system is configured to activate a diaphragm element of the at least one bistable diaphragm element with a control signal above a changeover threshold in order to change over between the first stable state and the second stable state, and to activate the diaphragm element or a further diaphragm element of the at least one bistable element with an activation signal below the changeover threshold.

Example 2

Diaphragm element arrangement according to example 1, wherein the control system is configured to carry out the activation below the changeover threshold in order to increase a dynamic range and/or a modulation depth.

Example 3

Diaphragm element arrangement according to example 1, wherein the at least one bistable diaphragm element comprises a multiplicity of bistable diaphragm elements, which are grouped into a multiplicity of groups, wherein each of the groups is assigned to a bit, wherein the control system is configured to activate a first part of the groups above the changeover threshold and to activate a second part of the groups below the changeover threshold.

Example 4

Diaphragm element arrangement according to example 3, wherein the control system is configured to activate the second part of the groups to compensate the overswings produced by activating the first part of the groups above the changeover threshold.

Example 5

Diaphragm element arrangement, comprising: a bistable diaphragm element having a first stable state and a second stable state, and a control system for activating the diaphragm element, wherein the control system is configured to activate the diaphragm element to excite a self-resonant vibration, and to activate the diaphragm element with a control signal below a changeover threshold which, without the resonant vibration, would be necessary to change over between the stable states, in order to change over between the stable states.

Example 6

Diaphragm element arrangement according to example 5, wherein the activation to change over between the stable states comprises applying voltage pulses to a piezoelectric element coupled to the diaphragm.

Example 7

Diaphragm element arrangement according to example 5, wherein the control system is configured to activate a further diaphragm element in anti-phase to the diaphragm element in order to excite a self-resonant vibration.

Example 8

Diaphragm element arrangement according to example 5, wherein the diaphragm element arrangement is configured in accordance with example 1.

Example 9

Method, comprising: activating a bistable diaphragm element having a first stable state and a second stable state above a changeover threshold in order to change over between the first and second stable state, and activating the bistable diaphragm element or a further bistable diaphragm element below the changeover threshold.

Example 10

Method according to example 9, wherein the bistable diaphragm element and the further bistable diaphragm element are provided in a diaphragm element arrangement, wherein diaphragm elements of the diaphragm element arrangement are activated in groups, wherein each group is assigned to a bit, wherein at least one group assigned to a higher-value bit is activated above the changeover threshold, and at least one group assigned to a lower-value bit is activated below the changeover threshold.

Example 11

Method according to example 9, wherein the activation below the changeover threshold compensates overswings which are produced by the activation above the changeover threshold.

Example 12

Method according to example 9, wherein the activation below the changeover threshold increases a dynamic range and/or a modulation depth.

Example 13

Method, comprising: setting a diaphragm of a bistable diaphragm element vibrating at a self-resonant frequency of the diaphragm, and changing over the bistable diaphragm element between two stable states by activation below a changeover threshold which, without the excitation to vibrate at the self-resonance, is necessary for the changeover.

Example 14

Method according to example 13, wherein the activation below the changeover threshold comprises applying voltage pulses to a piezoelectric element coupled to the diaphragm.

Example 15

Method according to example 13, further comprising setting a further diaphragm of a further bistable diaphragm element vibrating at a natural frequency of the further diaphragm in anti-phase to the vibrations of the diaphragm.

Example 16

Method according to example 13, wherein the method is carried out according to example 9.

In view of the variations and adaptations explained above, it can be seen that the exemplary embodiments illustrated serve merely for illustration and are not to be interpreted as restrictive.

What is claimed is:

1. A diaphragm element arrangement, comprising:

at least one bistable diaphragm element having a first stable state and a second stable state, and a control system for activating the at least one diaphragm element, wherein the control system is configured to activate a diaphragm element of the at least one bistable diaphragm element with a control signal above a changeover threshold in order to change over between the first stable state and the second stable state, and to activate the diaphragm element or a further diaphragm element of the at least one bistable diaphragm element with an activation signal below the changeover threshold, wherein the control system is configured to carry out the activation below the changeover threshold in order to increase a dynamic range and/or a modulation depth.

2. The diaphragm element arrangement as claimed in claim 1, wherein the at least one bistable diaphragm element comprises a multiplicity of bistable diaphragm elements, which are grouped into a multiplicity of groups, wherein each of the groups is assigned to a bit, wherein the control system is configured to activate a first part of the groups above the changeover threshold and to activate a second part of the groups below the changeover threshold.

3. The diaphragm element arrangement as claimed in claim 2, wherein the control system is configured to activate the second part of the groups to compensate overswings produced by activating the first part of the groups above the changeover threshold.

4. A diaphragm element arrangement, comprising:

a bistable diaphragm element having a first stable state and a second stable state, and a control system for activating the diaphragm element, wherein the control system is configured to activate the diaphragm element to excite a self-resonant vibration, and to activate the diaphragm element with a control signal below a changeover threshold which, without the resonant vibration, would be necessary to change over between the stable states, in order to change over between the stable states, and wherein the control system is configured to activate a further diaphragm element in anti-phase to the diaphragm element in order to excite a self-resonant vibration.

5. The diaphragm element arrangement as claimed in claim 4, wherein the activation to change over between the stable states comprises applying voltage pulses to a piezoelectric element coupled to the diaphragm.

6. A method, comprising:

activating a bistable diaphragm element having a first stable state and a second stable state above a changeover threshold in order to change over between the first and second stable state, and activating the bistable diaphragm element or a further bistable diaphragm element below the changeover threshold, wherein the activation below the changeover threshold increases a dynamic range and/or a modulation depth.

7. The method as claimed in claim 6, wherein the bistable diaphragm element and the further bistable diaphragm element are provided in a diaphragm element arrangement, wherein diaphragm elements of the diaphragm element arrangement are activated in groups, wherein each group is assigned to a bit, wherein at least one group assigned to a higher-value bit is activated above the changeover threshold, and at least one group assigned to a lower-value bit is activated below the changeover threshold.

8. The method as claimed in claim 6, wherein the activation below the changeover threshold compensates overswings which are produced by the activation above the changeover threshold.

9. A method, comprising:

setting a diaphragm of a bistable diaphragm element vibrating at a self-resonant frequency of the diaphragm, changing over the bistable diaphragm element between two stable states by activation below a changeover threshold which, without excitation to vibrate at the self-resonance, is necessary for the changeover, and setting a further diaphragm of a further bistable diaphragm element vibrating at a natural frequency of the further diaphragm in anti-phase to the vibrations of the diaphragm.

10. The method as claimed in claim 9, wherein the activation below the changeover threshold comprises applying voltage pulses to a piezoelectric element coupled to the diaphragm.

* * * * *